US009115561B2

(12) United States Patent
Gette et al.

(10) Patent No.: US 9,115,561 B2
(45) Date of Patent: Aug. 25, 2015

(54) LOAD ENHANCED LOCKING ARRANGEMENT

(75) Inventors: Nicholas Peter Gette, Houston, TX (US); Daniel Ralph Barnhart, Houston, TX (US); David Lawrence Ford, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 403 days.

(21) Appl. No.: 13/612,227

(22) Filed: Sep. 12, 2012

(65) Prior Publication Data

US 2014/0069632 A1 Mar. 13, 2014

(51) Int. Cl.
*E21B 33/04* (2006.01)
*E21B 33/03* (2006.01)

(52) U.S. Cl.
CPC ..... *E21B 33/0422* (2013.01); *E21B 33/03* (2013.01); *E21B 33/04* (2013.01)

(58) Field of Classification Search
CPC ..... E21B 33/03; E21B 33/035; E21B 33/04; E21B 33/044; E21B 23/02; E21B 23/03
USPC ..... 166/86.1, 75.14, 75.11, 368, 82.1, 208, 166/217; 277/338, 626, 648
See application file for complete search history.

(56) References Cited

U.S. PATENT DOCUMENTS 4,083,409 A * 4/1978 Barrington ..... 166/320
4,909,546 A * 3/1990 Nobileau ..... 285/123.4
4,949,787 A 8/1990 Brammer et al.
5,456,317 A 10/1995 Hood, III et al.
7,407,011 B2 8/2008 Kent
8,146,670 B2 4/2012 Ellis et al.
2003/0234109 A1* 12/2003 Marroquin et al. ..... 166/348
2005/0274526 A1* 12/2005 Thomas ..... 166/348
2010/0116489 A1* 5/2010 Nelson ..... 166/182
2011/0088893 A1* 4/2011 Gette et al. ..... 166/195

FOREIGN PATENT DOCUMENTS

EP 2239412 A2 10/2010

OTHER PUBLICATIONS

International Search Report and the Written Opinion issued in connnection with WO Application No. PCT/US2013/057212 on Sep. 12, 2014.

* cited by examiner

*Primary Examiner* — Nicole Coy
*Assistant Examiner* — Tara Schimpf
(74) *Attorney, Agent, or Firm* — Bracewell & Giuliani LLP

(57) ABSTRACT

In a wellhead near the top of an oil and gas well, a locking profile configured for locking engagement with an inner well member and including a locking ridge having a rib and a locking shoulder. The locking ridge extends radially inward from an inner surface of the wellhead into a well bore. The rib is located on an end of the ridge distal from the wellhead and protrudes into the inner well member. The locking shoulder is located on an end of the ridge distal from the wellhead and adjacent a lower end of the rib, so that as the inner well member exerts an upward force on the rib, the upward force creates a moment in the locking ridge that pushes the locking shoulder into tighter engagement with the inner well member.

12 Claims, 3 Drawing Sheets

LOAD ENHANCED LOCKING ARRANGEMENT

BACKGROUND OF THE INVENTION

1. Field of the Invention

This technology relates to wellhead assemblies. More particularly, this technology relates to an arrangement for locking inner well members to outer well members in wellhead assemblies.

2. Brief Description of Related Art

Typically, locking arrangements are used between inner and outer well members to help prevent relative axial movement between the members. For example, known locking mechanisms may lock a casing hanger in a wellbore. One example of such a mechanism is a locking ring, which may reside in a groove in the casing hanger as the casing hanger is inserted into the wellbore. The ring may then expand outwardly into partial engagement with a corresponding groove in the wellhead when the casing hanger is fully seated. While such an arrangement may be effective to prevent axial movement between the casing hanger and the wellhead, multiple parts are required to complete the arrangement, and some mechanical means is required to deploy the ring when the casing hanger is in place. Thus, such a locking arrangement may be too complicated for use in some wells.

Another example of a known locking arrangement is a profile that includes a series of ridges formed on the inner surface of a wellhead. When an inner well member, such as an annulus seal, is inserted into the wellhead it may have pre-cut grooves that correspond to the ridges. Alternatively, the inner well member may be constructed of a material that is softer than the ridges, and energized into plastic deformation around the ridges. The ridges of such profiles typically have a positively angled upper surface and a negatively angled lower surface. One problem with such profiles is that, because the surfaces are angled, any upward force exerted by the inner well member on the ridges has both a vertical component and a radial component. The radial component tends to reduce engagement of the casing hanger from the ridges when under load. In some instances, this may lead to failure of the locking profile and harmful relative axial movement between the wellhead and the casing hanger.

SUMMARY OF THE INVENTION

Disclosed herein is a locking profile for restraining relative movement between an inner well member and an outer well member. In one example, the locking profile includes locking ridges positioned along the inner surface of the outer well member that extend outwardly and downwardly from the outer well member. The locking ridges may each include a rib and a locking shoulder.

The rib may have an upper, positively angled surface, and a lower, negatively angled surface, and is arranged to be received by and engage the inner well member. The positive angle of the upper surface may be beneficial because it increases the effective shear area of the profile, thereby strengthening the rib. The lower surface is configured to receive an upward force exerted on the locking ridge by the inner well member.

The locking shoulder is positioned below the rib and has a vertical surface that is adjacent to, and may be substantially parallel to, the surface of the inner well member. When the inner well member exerts a force on the lower surface of the rib, the force is transmitted into the locking ridge and creates a bending moment in the ridge. The moment pushes the vertical surface of the locking shoulder into tighter contact with the surface of the inner well member, thereby further preventing axial movement of the inner well member relative to the outer well member.

BRIEF DESCRIPTION OF THE DRAWINGS

The present technology will be better understood on reading the following detailed description of nonlimiting embodiments thereof, and on examining the accompanying drawings, in which.

DETAILED DESCRIPTION OF THE PREFERRED EMBODIMENT

Figure 1:
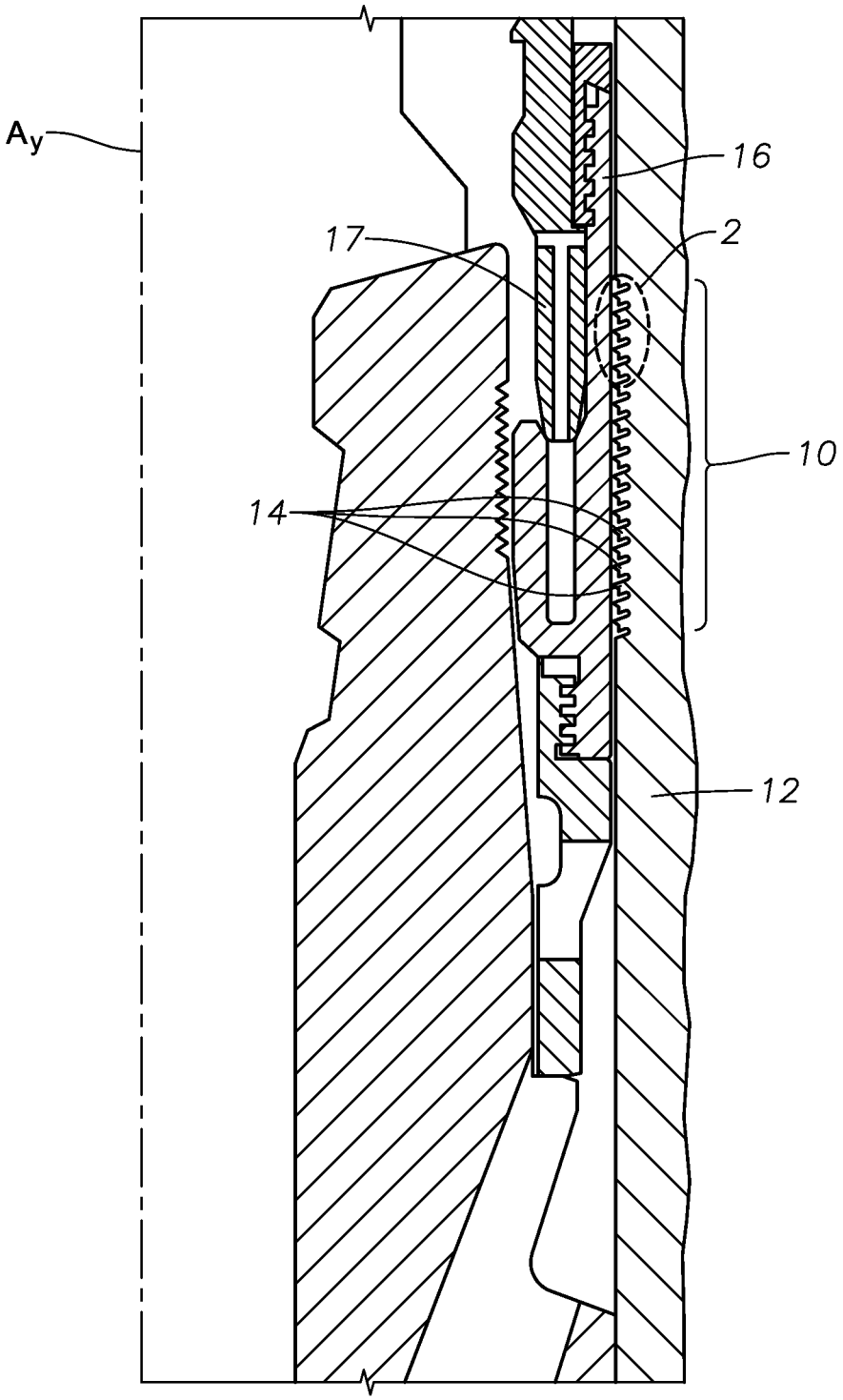
FIG. 1 is a cross-sectional partial side view of a wellhead assembly including a locking profile according to an example embodiment of the present technology.

The foregoing aspects, features, and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. However, the technology is not intended to be limited to the specific terms used, and it is to be understood that each specific term includes equivalents that operate in a similar manner to accomplish a similar purpose.

The present technology may be used in oil and gas wells, and in particular in wellheads at the top of the wells. Typical wellheads may serve a number of different functions, including casing suspension, tubing suspension, pressure sealing, and so forth. Some of these functions require an inner well member, such as, for example, an annulus seal, to be inserted into the wellhead, and locked axially relative to the wellhead.

Figure 2:
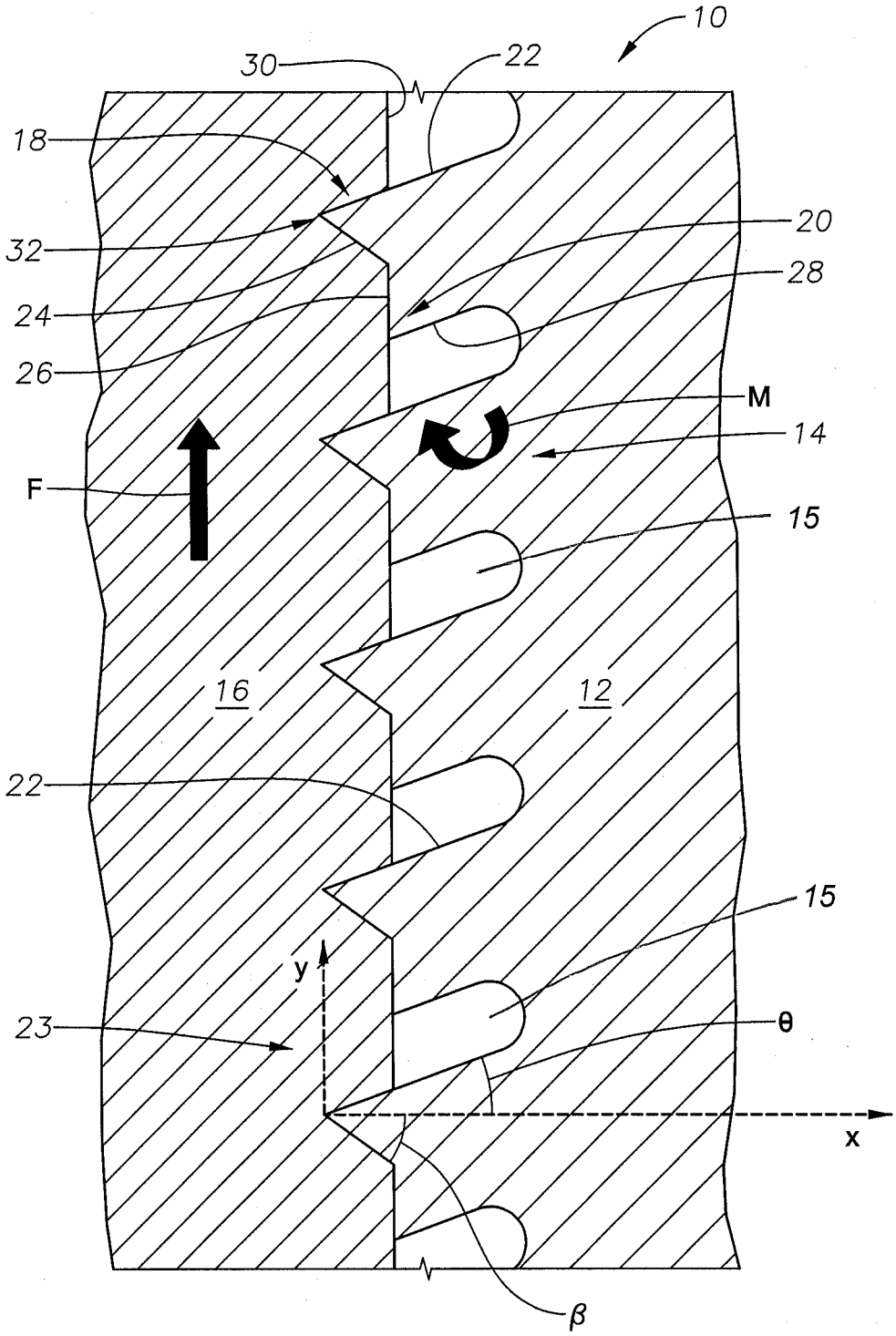
FIG. 2 is partial cross-sectional side view of the locking profile of FIG. 1, as indicated by area 2 in FIG. 1.

FIG. 1 is a cross-sectional side view of a wellhead assembly, including a locking profile 10 between an outer well member 12 and an inner well member 16. In the example embodiment of FIG. 1, the outer well member 12 is a wellhead, and the inner well member 16 is an annulus seal. An energizing ring 17 is positioned adjacent the inner well member 16. The energizing ring 17 has an up position (shown in FIG. 1) and a down position (not shown). When in the up position, the energizing ring 17 allows the inner well member 16 to be disengaged from the locking profile 10. When in the down position, however, the energizing ring 17 exerts an outward radial force on the inner well member 16, thereby forcing the inner well member 16 into engagement with the locking profile 10, as best shown in FIG. 2. Once engaged, inner well member 16 is secured to outer well member 12 with locking ridges 14 that constrain relative axial movement between the inner well member 16 and the outer well member 2, as explained more fully below, FIG. 2 is an enlarged cross-sectional side view of the locking profile 10. In FIG. 2, an inner circumference of the outer well member 12 is shown with a plurality of locking ridges 14 projecting radially inward and arranged and designed for engagement with an inner well member 16. The locking ridges 14 are each separated by a recess 15. As can be seen, the inner surface of each locking ridge 14 is V-shaped, with the apex of the V pointing outwardly away from the axis $A_y$ of the inner well member. The outer well member 12 may be, for example, a wellhead housing, and the inner well member 16 may be, for example, a casing hanger. Each locking ridge 14 includes a rib 18 and a locking shoulder 20, and may be angled downwardly and inwardly toward the axis $A_y$ of the well bore (shown in FIG. 1). As explained below, the rib 18 and locking shoulder 20 act together to restrain upward movement of the inner well member 16.

In the example embodiment shown, the upper surface 22 of each locking ridge 14 may optionally have a positive angle. As used herein, the term positive angle may be defined by reference to a Cartesian coordinate system 23 having a y axis parallel to the axis $A_y$ of the well bore (shown in FIG. 1), and an x axis perpendicular to the y axis. A positive angle is an angle that is rotated counterclockwise from the x axis some distance θ. The angle θ may be in the range of about 0 degrees to about 90 degrees. Similarly, a negative angle is an angle that is rotated clockwise from the x axis some distance β. The angle β may be in the range of about 0 degrees to about 90 degrees.

The positive angle of upper surface 22 is advantageous because the upper surface 22 acts as the load flank of the locking profile, and the positive angle increases the effective shear area of the profile when in use. Moreover, the positively angled upper surface 22 facilitates retrieval of the inner well member 16 as compared to a non-angled or negatively angled upper surface because forces act through it in both a radial and an axial direction. The radial component acts to reduce engagement of the inner well member 16 from the locking profile when under load, thereby aiding in retrieval of the inner well member, if necessary.

As shown in FIG. 2, rib 18 is made up of an upper portion of the ridge 14 that projects radially inward. The upper surface of the rib 18 generally coincides with a portion of the upper surface 22, and a lower surface 24 of the rib 18, distal from outer well member 12, depends downward and radially inward from the inward terminal end of upper surface 22, so that the circumferential section of the rib 18 has a generally wedge like configuration. Thus, the lower surface 24 of each locking ridge 14 has a negative angle.

When members 12, 16 are engaged as shown in FIG. 2, a portion of the lower surface 24 engages the inner well member 16, and is positioned to restrain upward movement of the inner well member 16. The rib 18 of each locking ridge 14 includes both the lower surface 24 and the portion of the upper surface 22 that engages the inner well member 16. Because the rib 18 includes the lower surface 24, the rib 18 helps limit upward movement of the inner well member 16 relative to the outer well member 12.

The locking shoulder 20 of each locking ridge 14 is positioned below the rib 18, and includes a vertical surface 26 that extends from a lower end of lower surface 24 to a lower surface 28 of the locking ridge 14. The vertical surface 26 of the locking shoulder 20 is, in the example shown, substantially parallel to the well bore axis, and is positioned to be adjacent the outer surface 30 when the outer well member 12 engages the inner well member 16. Optionally, the vertical surface 26 may contact the outer surface 30 of the inner well member 16.

Inner well member 16 is configured to enter into locking engagement with the locking ridges 14 of the outer well member 12. In one example embodiment, the inner well member 16 may have grooves 32 configured to accept the ribs 18 of the locking ridges 14. In another example embodiment, the inner well member 16 may be made of a softer material than the locking ridges 14, and may be radially energized until the outer surface 30 of the inner well member 16 plastically deforms, and accepts the ribs 18 of the locking ridges 14 to form grooves 32. In example embodiments, the inner well member 16 may be radially engaged to the locking profile 10 by known methods, e.g., via the energizing ring 17 shown in FIG. 1, that wedges the inner well member 16 into position. When fully seated and/or energized within the outer well member 12, the outer surface 30 of the inner well member 16 receives ribs 18 of the locking ridges 14 and is adjacent the vertical surfaces 26 of the locking shoulders 20 of the locking ridges 14.

In practice, the inner well member 16 is subjected to upward force F that may result from, for example, thermal expansion, or downhole pressure in the annulus of the wellbore, and may have a magnitude of about 30 to 40 ksi. In one embodiment, force F has a magnitude of about 36 ksi. Upward force F is transferred from the inner well member 16 to the locking ridges 14 through the lower surface 24. Contact between inner well member 16 and the lower surface 24 converts the force F into vertical and radial components of force in the ridges 14. The vertical component from force F pushes the lower surface 24 upward, and creates a bending moment M in each locking ridge 14. In one embodiment, the lower surface 24 may be pushed upward a distance of about 0.125 to about 0.25 inch. The bending moment M in turn causes the vertical surface 26 of the locking shoulder 20 to rotate radially inward and upward into tighter engagement with the outer surface 30 of the inner well member 16. This tighter engagement further restrains upward movement of the inner well member 16 relative to the locking ridges 14, thereby enhancing the load carrying capabilities of the profile 10.

Figure 3:
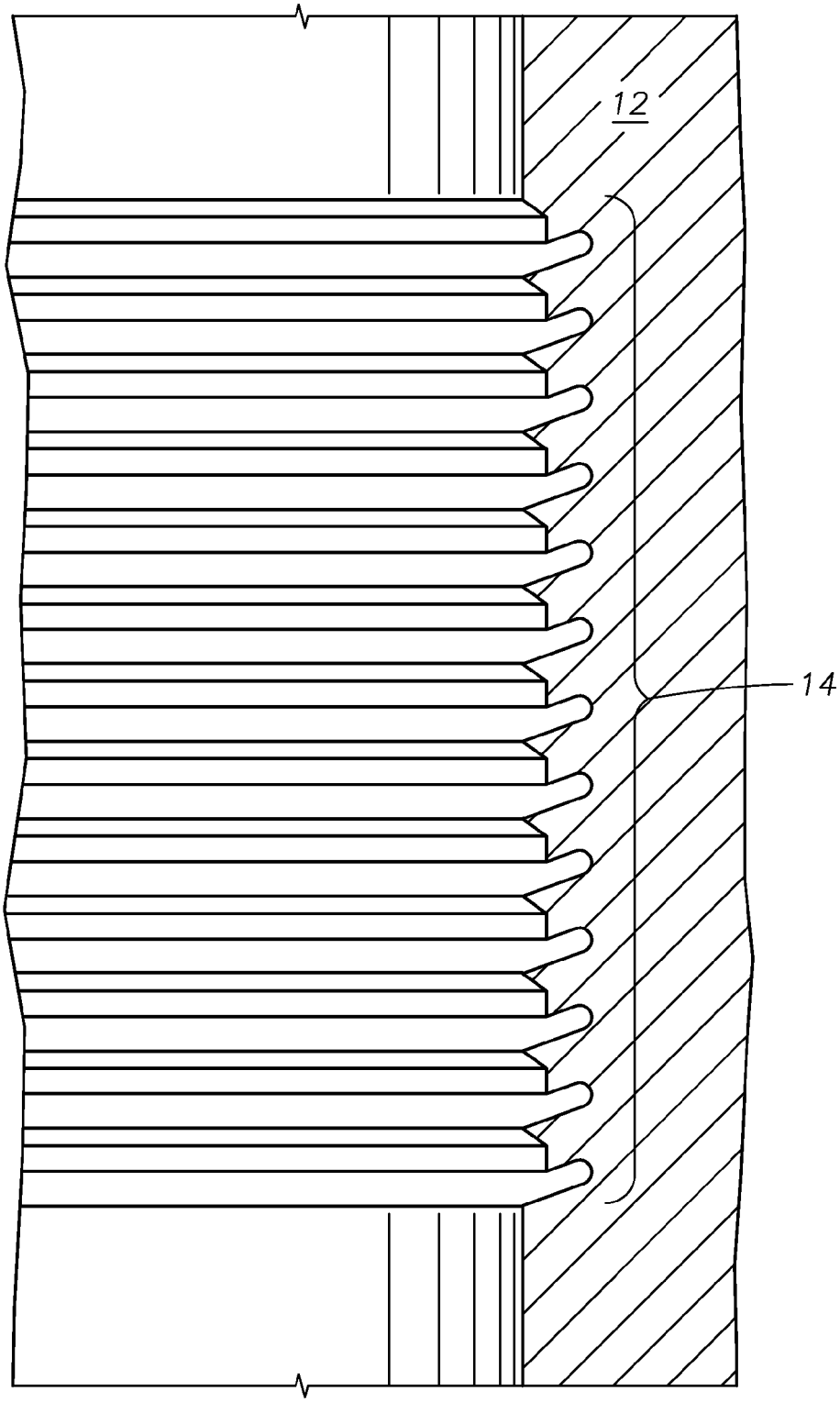
FIG. 3 is a partial cross-sectional side view of an outer tubular member including locking ridges according to an example embodiment of the present technology.

FIG. 3 show a portion of an outer well member 12 having locking ridges 14, and without an inner well member inserted therein. As can be seen, in the example embodiment shown, the locking ridges 14 may extend circumferentially around the inner surface of the outer well member 12. Of course, it is to be understood that in some embodiments the locking ridges 14 may not extend continuously around the circumference, but may instead be positioned circumferentially around the inner surface of the outer well member 12 at select intervals.

While the technology has been shown or described in only some of its forms, it should be apparent to those skilled in the art that it is not so limited, but is susceptible to various changes without departing from the scope of the invention. Furthermore, it is to be understood that the above disclosed embodiments are merely illustrative of the principles and applications of the present invention. Accordingly, numerous modifications may be made to the illustrative embodiments and other arrangements may be devised without departing from the spirit and scope of the present invention as defined by the appended claims.

What is claimed is:

1. A locking profile in a wellhead configured for locking engagement with an inner well member, the locking profile of the wellhead comprising:

a plurality of locking ridges protruding inward toward the axis of a wellbore, each of the plurality of locking ridges separated by a recess and comprising:

a rib and a locking shoulder on an end of the locking ridge distal from the wellhead, the rib for protruding into the inner well member, the locking shoulder immediately adjacent and contacting a lower end of the rib, and having an inner surface oriented substantially parallel to the longitudinal axis of the wellbore, so that as the inner well member exerts an upward force on the rib, the upward force creates a moment in the locking ridge that pushes the locking shoulder into tighter engagement with the inner well member.

2. The locking profile of claim 1, wherein the locking ridge depends downward away from the wellhead.

3. The locking profile of claim 1, wherein the inner well member is made of a material that is soft relative to the locking ridge and that can be plastically formed into engagement with the locking ridge.

4. The locking profile of claim 1, wherein the inner well member is an annulus seal.

5. The locking profile of claim 1, wherein the rib of each locking ridge has a positively angled upper surface.

6. A locking arrangement for locking members in a wellhead, comprising:

an outer tubular member defining a bore having a bore axis, and further having a plurality of inwardly protruding locking ridges, the locking ridges of the outer tubular member each separated by a recess and comprising:

an upper rib portion having an upper positively angled surface and a lower negatively angled surface, and protruding inward toward the bore axis;

a lower shoulder portion having an inner surface substantially parallel to the longitudinal axis of the bore and protruding inward toward the bore axis a lesser distance than the upper rib portion, the lower shoulder portion immediately adjacent and contacting the upper rib portion; and an inner tubular member having an outer surface, the inner tubular member positioned so that the outer surface receives the upper rib portion of the locking ridges, and so that the inner surface of the lower shoulder portion is substantially parallel to, and substantially adjacent to, the outer surface of the inner tubular member.

7. The locking arrangement of claim 6, wherein the locking ridges are arranged so that upon application of an upward force by the inner tubular member on the lower negatively angled surfaces of the upper rib portions, the locking ridges undergo a bending moment that rotates the inner surfaces of the lower shoulder portions into locking engagement with the outer surface of the inner tubular member.

8. The locking arrangement of claim 6, wherein the inner tubular member has pre-cut grooves configured to accept the upper rib portions of the locking ridges.

9. The locking arrangement of claim 6, wherein the inner tubular member is made of a material that is soft relative to the locking ridges and that can be plastically formed into engagement with the locking ridges.

10. The locking arrangement of claim 6, wherein the inner tubular member is an annulus seal.

11. The locking arrangement of claim 6, wherein the outer tubular member is a wellhead.

12. A locking profile in a wellhead configured for locking engagement with an inner well member having an axis, the locking profile of the wellhead comprising:

a plurality of locking ridges, each separated by a recess, having a locking shoulder, and extending radially inward from the wellhead into a well bore and into engagement with the inner well member, each locking ridge having a rib with an upper surface and a lower surface, and a locking shoulder having an inner surface and a lower surface, each locking ridge having a V-shaped inner surface where a first leg of the V comprises the lower surface of the rib, and a second leg of the V comprises the inner surface of the locking shoulder, the V-shaped inner surface configured so that the apex of the V points radially outward away from the axis of the inner well member, and the second leg of the V is oriented substantially parallel to the axis of the inner well member;

wherein the locking ridges are configured so that as the inner well member exerts an upward force on the locking ridges, the upward force creates a moment in the locking ridges that pushes the locking shoulders into tighter engagement with the inner well member.

* * * * *